US007147591B2

(12) United States Patent
McAvoy

(10) Patent No.: US 7,147,591 B2
(45) Date of Patent: Dec. 12, 2006

(54) UNIVERSAL FITNESS APPARATUS

(75) Inventor: Kevin J. McAvoy, Cleveland, GA (US)

(73) Assignee: Pentagon South Inc., Cleveland, GA (US)

( * ) Notice: Subject to any disclaimer, the term of this patent is extended or adjusted under 35 U.S.C. 154(b) by 4 days.

(21) Appl. No.: 11/207,321

(22) Filed: Aug. 19, 2005

(65) Prior Publication Data

US 2006/0058158 A1 Mar. 16, 2006

Related U.S. Application Data

(60) Provisional application No. 60/609,202, filed on Sep. 10, 2004.

(51) Int. Cl.
*A63B 21/02* (2006.01)
*A63B 1/00* (2006.01)

(52) U.S. Cl. ..... 482/91; 482/92; 482/39; 482/148; 482/907

(58) Field of Classification Search ..... 482/23, 482/33, 91, 35–42, 92, 95, 96, 148, 139–141, 482/143, 904, 907, 908; D21/662, 686; 182/100, 189; 211/101, 95, 163, 166
See application file for complete search history.

(56) References Cited

U.S. PATENT DOCUMENTS

| | | | | | |
|---|---|---|---|---|---|
| 393,247 | A | * | 11/1888 | Lambert | 211/95 |
| 528,498 | A | * | 10/1894 | Anderson | 211/101 |
| 770,037 | A | * | 9/1904 | Anderson | 211/101 |
| 775,184 | A | * | 11/1904 | Kochsmeier | 211/101 |
| 986,711 | A | * | 3/1911 | Herscovitz | 211/95 |
| 1,008,905 | A | * | 11/1911 | Herscovitz | 211/183 |
| 1,585,748 | A | | 5/1926 | Wendelken | |
| 4,301,891 | A | * | 11/1981 | Harbian | 182/135 |
| 4,620,701 | A | * | 11/1986 | Mojden | 482/41 |
| 4,620,704 | A | | 11/1986 | Shifferaw | |
| 4,725,057 | A | | 2/1988 | Shifferaw | |
| 4,865,283 | A | * | 9/1989 | Parker | 248/159 |
| 4,889,246 | A | * | 12/1989 | Lee | 211/163 |
| 5,162,030 | A | | 11/1992 | Tanski | |
| 5,256,069 | A | * | 10/1993 | Snowden et al. | 434/247 |
| 5,352,170 | A | * | 10/1994 | Condo et al. | 482/83 |
| 5,389,057 | A | * | 2/1995 | Zagata, Jr. | 482/83 |
| 5,453,067 | A | | 9/1995 | Cianfrocca, II | |
| 5,722,920 | A | * | 3/1998 | Bauer | 482/83 |
| D401,985 | S | * | 12/1998 | Wheeler | D21/686 |
| 5,997,448 | A | * | 12/1999 | Duba | 482/121 |
| 6,217,483 | B1 | * | 4/2001 | Kallassy | 482/38 |

(Continued)

*Primary Examiner*—Glenn E. Richman
*Assistant Examiner*—Victor K. Hwang
(74) *Attorney, Agent, or Firm*—King & Spalding LLP

(57) ABSTRACT

A universal fitness apparatus for force resistance, postural, and balance exercises. A flange assembly is coupled to a longitudinal shaft. The flange assembly can comprise receptacles for receiving handles or it can itself comprise handles. A user can support herself with the handles while performing a variety of exercises that target multiple muscle groups. The height of the handles can be adjusted by sliding the flange assembly along the shaft. Alternatively, the flange assembly and shaft can be mounted to a height adjustable runner coupled to a longitudinal track. A pin and/or lock to hold the flange assembly and/or runner at a particular height can be provided. The flange assembly can be rotationally coupled to the shaft so that the user can move the handles while performing oblique muscle movements. The receptacles and/or the handles can be pivotally movable such that the handles can be stored in an upright position.

22 Claims, 6 Drawing Sheets

U.S. PATENT DOCUMENTS

| | | | | |
|---|---|---|---|---|
| 6,436,019 | B1 | 8/2002 | Hollowell | |
| 6,786,849 | B1 | 9/2004 | Faulconer | |
| 6,887,190 | B1 | 5/2005 | Azari | |
| 2002/0025892 | A1 | 2/2002 | Chapman et al. | |
| 2002/0123415 | A1 | 9/2002 | Marques | |
| 2002/0193211 | A1* | 12/2002 | Kao | 482/83 |
| 2003/0186794 | A1 | 10/2003 | Vittone | |
| 2005/0124469 | A1* | 6/2005 | Melvin | 482/83 |

* cited by examiner

UNIVERSAL FITNESS APPARATUS

RELATED APPLICATION

The present application claims priority under 35 U.S.C. § 119 to U.S. Provisional Patent Application No. 60/609,202 entitled "Personal Strength and Balance Machine," filed Sep. 10, 2004, which is hereby incorporated by reference.

TECHNICAL FIELD

The present invention relates generally to fitness equipment used for muscle conditioning and development and more specifically to a convenient, space-conscious, universal fitness apparatus for force resistance, postural, and balance exercises that target multiple muscle groups.

BACKGROUND OF THE INVENTION

Health officials have repeatedly stressed the importance of regular muscle conditioning and development exercises to help build bone density, increase lean body mass, and improve balance. Such exercises are especially important for persons suffering from, or predisposed to developing, the bone debilitating disease osteoporosis. Osteoporosis is a disease in which bones are weakened and thinned. Individuals with osteoporosis are at increased risk of bone fracture and spinal curvature. The most effective way to counter the risks and effects of osteoporosis is a complete fitness routine comprising force resistance, postural, and balance exercises.

Force resistance training and other weight-bearing activities such as walking, jogging, and dancing, induce the body to work against added weight and gravity. Over time, such activities strengthen the body's supporting structures (muscles, tendons, ligaments, and bones), develop greater muscular balance, and enhance the ability of tissues to absorb more force. Postural exercises help to decompress the spine, maintain proper body alignment, and decrease harmful stress on the back. As a result, postural exercises can reduce the risk of spinal fractures and spinal curvature in persons with osteoporosis. Balance exercises are designed to improve balance and decrease the risk of bone fracturing falls that are currently the leading cause of mobility related injuries suffered by women diagnosed with, or prone to, osteoporosis.

A complete fitness routine of force resistance, postural, and balance exercises generally requires multiple pieces of fitness equipment. In general, traditional pieces of fitness equipment are each directed to only one of the three recommended exercise types. For example, the adjustable hand grip exerciser described in U.S. Pat. No. 6,786,849 to Faulconer is only directed to force resistance exercises, and the competitive exercise game device described in U.S. Pat. No. 6,436,019 to Hollowell is only directed to balance exercises. In addition, traditional fitness apparatuses typically target only a specific body segment, such as the lower body, or a specific "problem area," such as the abdomen or buttocks. Thus, there is a need for a universal fitness apparatus that targets multiple muscle groups and is directed to force resistance, postural, and balance exercises.

Conventional approaches to overcome this need have proven unsatisfactory. Existing universal fitness apparatuses, such as the apparatus described in U.S. Pat. No. 4,620,704 to Shifferaw, are complex devices that are cumbersome, space-consuming, and expensive.

Therefore, there is a present need for a convenient, space-conscious, universal fitness apparatus for force resistance, postural, and balance exercises. In addition, there is a need for such an apparatus to be affordable. The present invention solves these needs.

SUMMARY OF THE INVENTION

The present invention satisfies the above-described needs by providing a convenient, space-conscious, universal fitness apparatus for force resistance, postural, and balance exercises. The universal fitness apparatus comprises a longitudinal shaft. Coupled to the longitudinal shaft is a flange assembly comprising a first receptacle configured for receiving a first handle and a second receptacle configured for receiving a second handle. The first handle can be coupled to the first receptacle and the second handle can be coupled to the second receptacle. The receptacles can be disposed substantially perpendicular to the longitudinal shaft, so that when handles are coupled to the receptacles, the handles will extend outward from the longitudinal shaft. When the handles are so installed, the user can grasp the handles and perform a variety of force resistance, postural, and balance exercises by e.g., applying personal counterforce resistance and overcoming gravity.

Similarly, the handles can be disposed substantially perpendicular to one another. If the handles are disposed in such a manner, the apparatus will simulate an upright wall corner. Standing in a corner with hands held at shoulder height and exerting user supplied counterforce against the walls is one of the best conditioning movements for the muscles of the back, shoulders, and chest. Homes, work buildings, gyms, parks, and other locations at which people exercise, have limited numbers of available corners. Rather than search for an available corner, the user can stand in front of the longitudinal shaft and exert counterforce against the handles to condition his back, shoulder, and chest muscles.

Ordinarily, the longitudinal shaft is disposed in a substantially vertical position. To maintain that position, the apparatus can be mounted or attached to a wall, a door, a floor, the ground, and/or another suitable support means.

The flange assembly can be configured to slide along the axis of the longitudinal shaft. By providing a height-adjustable flange assembly, the user can raise or lower the flange assembly to a preferred operation height and thus customize his fitness routine. A collar can be provided to hold the flange assembly in place at the user's preferred operation height.

In another aspect of the present invention, the flange assembly can be rotationally coupled to the longitudinal shaft so that when the handles are installed, the user can rotate the handles about the longitudinal shaft. By allowing the user to rotate the handles, the user can control and vary the available counterforce resistance applied as well as the angle of application.

The receptacles and/or the handles can be pivotally movable relative to an axis substantially perpendicular to the longitudinal shaft. Accordingly, after using the apparatus, the user can fold the handles to an upright position for convenient storage and space conservation.

The handles can be removably or fixedly coupled to the flange assembly. Alternatively, the flange assembly itself can comprise the handles. If the handles are removably coupled to the flange assembly, the user can remove the handles for compact storage while the apparatus is not in use.

In accordance with other aspects of the invention, the universal fitness apparatus comprises a longitudinal track. Coupled to the longitudinal track is a height adjustable runner. The runner is configured to slide along the axis of the longitudinal track. The runner can be configured to slide along the interior axis or the exterior axis of the longitudinal track. A connecting pin can be placed in horizontally aligned holes drilled into the longitudinal track and runner to hold the runner in place at the user's preferred operation height.

Mounted to the runner is a flange assembly. The flange assembly can be mounted to the runner by means of a longitudinal shaft coupled to the runner. In such a configuration, the longitudinal shaft ordinarily is disposed parallel to the runner, and the flange assembly is disposed about the longitudinal shaft. The flange assembly can be rotationally coupled to the longitudinal shaft. Alternatively, or in conjunction with being disposed about the longitudinal shaft, the flange assembly can rest on a support coupled to the runner. The flange assembly can be removably or permanently mounted to the runner.

Additional aspects, features, and advantages of the invention will become apparent to those skilled in the art upon consideration of the following detailed description of illustrated embodiments exemplifying the best mode of carrying out the invention as presently perceived.

DETAILED DESCRIPTION OF EXEMPLARY EMBODIMENTS

Figure 1:
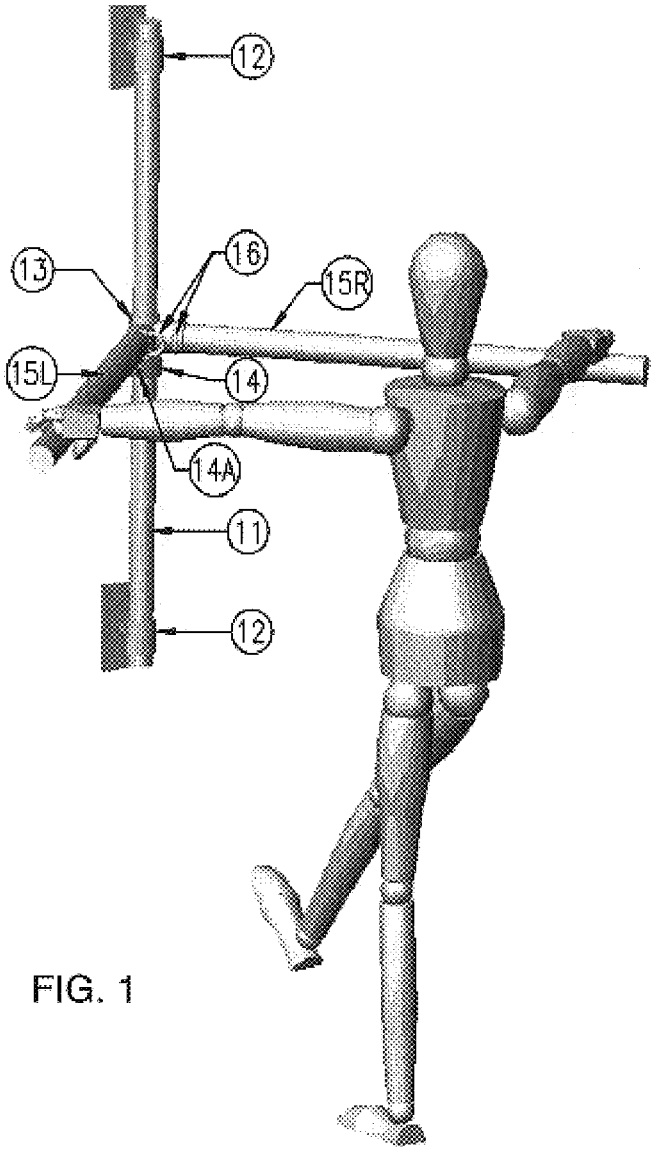
FIG. 1 is an illustration of a left side perspective view of a universal fitness apparatus, according to an exemplary embodiment of the present invention, shown employed by a user performing a leg lift exercise.

The present invention is directed to a universal fitness apparatus. A convenient, space-conscious, universal fitness apparatus for force resistance, postural, and balance exercises can help users build bone density, increase lean body mass, and improve balance. It can also help users to counter the risks associated with the bone debilitating disease osteoporosis.

In accordance with an exemplary embodiment of the present invention, the universal fitness apparatus comprises a longitudinal shaft with a height adjustable flange assembly. Coupled to, or components of, the flange assembly are two handles. The handles allow the user to perform a variety of force resistance, postural, and balance exercises by e.g., applying personal counterforce resistance and overcoming gravity. By providing a height adjustable flange assembly, the handles can be adjusted to the precise work height and angle for maximum conditioning and therapeutic benefit. The provided flange assembly movement allows unlimited handle elevation settings to accommodate the individual user.

In certain embodiments of the present invention, the flange assembly, and thus each of the handles, is rotationally coupled to the longitudinal shaft. Movements performed using the rotating handles allow the user to control and vary the available counterforce resistance applied as well as the angle of application. In certain other embodiments of the present invention, the handles are pivotally movable relative to an axis substantially perpendicular to the longitudinal shaft. Accordingly, after using the apparatus, the user can fold the handles to an upright position for convenient storage and space conservation.

In accordance with another exemplary embodiment of the present invention, multiple flange assemblies can be stacked along the longitudinal shaft to allow simultaneous use of the apparatus by multiple persons. For example, with multiple flange assemblies, training, dance, or exercise partners can utilize the apparatus simultaneously.

In accordance with an alternative exemplary embodiment of the present invention, the universal fitness apparatus comprises a longitudinal track with a height adjustable runner. Coupled to, or a component of, the runner is means for mounting a flange assembly to the runner. In certain embodiments of the present invention, the mounting means can comprise a longitudinal shaft and/or a shaft support. In such embodiments, the flange assembly can be configured to slide along the longitudinal shaft and rest on the shaft support. The flange assembly can be removably or permanently mounted to the runner.

Coupled to, or components of the flange assembly, are two handles. In certain embodiments of the present invention, the flange assembly, and thus each of the handles, is rotationally coupled to the longitudinal shaft. Movements performed using the rotating handles allow the user to control and vary the available counterforce resistance applied as well as the angle of application.

Turning now to the drawings, in which like numerals indicate like elements throughout the several figures, exemplary embodiments of the invention are described in detail.

Figure 2:
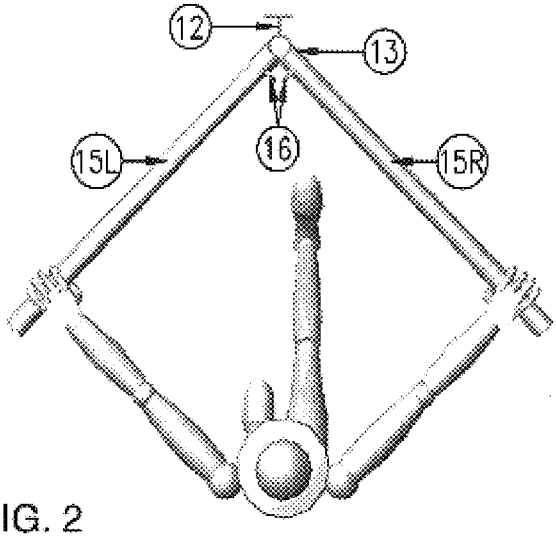
FIG. 2 is an illustration of an overhead working view of a universal fitness apparatus, according to an exemplary embodiment of the present invention, shown employed by a user performing a leg lift exercise.

FIGS. 1 and 2 illustrate a universal fitness apparatus, according to an exemplary embodiment of the present invention, shown employed by a user performing a leg lift exercise. The universal fitness apparatus comprises a longitudinal shaft 11, secured at each end to a supporting structure (not shown) by means of two standard rail flanges 12. The rail flanges 12 and supporting structure help to maintain the shaft 11 in a substantially vertical position. In certain embodiments of the present invention, alternative means can be utilized for that purpose. For example, the apparatus can be secured to a supporting structure using straps, brackets, braces, hooks, clips, rings, loop fasteners, ties, pins, screws, nails, concrete, adhesive glue or tape, welding, and/or any other suitable mounting or attachment means. The mounting or attachment means can be disposed on or near any number of sites on the apparatus and/or the supporting structure. In addition, any number of supporting structures can be utilized. For example, a supporting structure can be a floor, a wall, a door, a beam, a ceiling, the ground, and/or any other suitable supporting means.

The shaft 11 can comprise metal, such as aluminum or steel, plastic, wood, and/or any other suitable material known in the art. The shaft 11 can be solid, hollow, or semi-solid. Though the shaft 11 illustrated in the figures has a cylindrical shape, in alternative embodiments of the present invention, the shaft 11 can have any of a number of other suitable shapes, including without limitation a rectangular shape. The shaft 11 ordinarily will have a length between approximately three and seven feet and a diameter between approximately 1¼ and 1½ inches. It will be readily apparent to one of ordinary skill in the art that the length and diameter of the shaft 11 can vary depending upon the intended use of the apparatus. For example, an apparatus intended to be mounted to an interior wall of a house for use by a family can have a smaller shaft 11 length and diameter than that of an apparatus intended to be placed in an outdoor recreation facility for use by the public.

Coupled to the longitudinal shaft 11 is a flange assembly 13 comprising two receptacles for receiving handles (15L, 15R). Also coupled to the longitudinal shaft 11 is an adjustable collar 14 configured to hold the flange assembly 13 in place at a particular position along the axis of the longitudinal shaft 11. The flange assembly 13 and the collar 14 each can be configured to slide along the longitudinal shaft 11. A user of the apparatus can raise or lower the flange assembly 13 to a desired height and then lock the flange assembly 13 in place with the collar 14.

As shown, the collar 14 can be disposed below the flange assembly 13 to support the flange assembly 13 at its operating height. In alternative embodiments of the present invention, the collar 14 can be disposed above the flange assembly 13, to the side of the flange assembly 13, between the flange assembly 13 and the shaft 11, within the flange assembly 13, or at any other suitable location. The collar 14 comprises a locking mechanism to secure the collar 14 and/or the flange assembly 13 at a particular location along the shaft 11. As illustrated in FIG. 1, the locking mechanism comprises an Allen screw 14A with static pressure release. Other methods for securing the collar 14 and/or the flange assembly 13 will occur to those of ordinary skill in the art.

Though the interiors of the flange assembly 13 and the collar 14 are both illustrated in the figures as having generally cylindrical shapes, in alternative embodiments of the present invention, each of the interiors of the flange assembly 13 and the collar 14 can have any of a number of other shapes that are suitable for sliding along the shaft 11. In addition, though illustrated as surrounding the shaft 11, neither the flange assembly 13 nor the collar 14 is required to surround the shaft 11. Other suitable dispositions, including partially surrounding the shaft 11 and within the interior of the shaft 11, will be apparent to those skilled in the art.

Each of the receptacles of the flange assembly 13 is configured to receive a handle (15L, 15R). Each handle (15L, 15R) can be secured to the flange assembly 13 using removable detention pins 16, placed in vertically aligned holes drilled into the handle (15L, 15R) and the flange assembly 13. When the apparatus is not in use, the user can remove the handles (15L, 15R) from the receptacles for compact storage. Other methods for securing the handles (15L, 15R) to the flange assembly 13, including without limitation straps, brackets, braces, hooks, clips, rings, loop fasteners, ties, pins, screws, nails, concrete, adhesive glue or tape, and/or any other suitable attachment means will occur to those of ordinary skill in the art. Such methods can removably or permanently secure the handles (15L, 15R) to the flange assembly 13.

Though illustrated in the Figures as tubular members, the handles (15L, 15R) can be of any suitable shape, and comprise any suitable material, for supporting a user. Ordinarily, the handles (15L, 15R) will have a length of approximately 24 inches and a diameter between approximately 1¼ and 1⅜ inches. It will be readily apparent to one of ordinary skill in the art that the length and diameter of each handle (15L, 15R) can vary depending upon the intended use of the apparatus. In alternative embodiments of the present invention, rather than comprise receptacles for receiving handles (15L, 15R), the flange assembly 13 itself can comprise the handles (15L, 15R). Hereinafter, the combination of the flange assembly 13 and the secured handles (15L, 15R) is referred to as a "handlebar assembly."

The receptacles of the flange assembly 13 are disposed substantially perpendicular to one another and to the longitudinal shaft 11. As a result, when the handles (15L, 15R) are secured to the receptacles, the apparatus simulates an upright wall corner. The user can adjust the height of the flange assembly 13 to his shoulder height and secure the height of the flange assembly 13, thus securing the height of the handlebar assembly, using the collar 14. Then the user can stand upright, facing the longitudinal shaft, place his hands on the handles (15L, 15R), and exert counterforce against the handles (15L, 15R) to develop and condition his back, shoulders, and chest muscles. Through such operation, the user simultaneously performs force resistance, postural, and balance exercises. In alternative embodiments of the present invention, the flange assembly 13 receptacles can be disposed at other angles suitable for such exercises. For example, the receptacles can be disposed at a more shallow, 45° angle, or at a wider, 180° angle. In further alternative embodiments, the receptacles can be pivotally coupled relative to one another and/or to the shaft 11 so that the user can customize the angle between the receptacles and/or the angle between the receptacles and the shaft 11.

As illustrated in FIGS. 1 and 2, the user can grip the handles (15L, 15R) for support while performing a variety of exercises. That support from the handles (15L, 15R) can help certain users who have trouble standing or who ordinarily require assistance while exercising to confidently retain complete control and balance throughout their personal exercise routine. In particular, the support can be useful for persons suffering from osteoporosis or other debilitating diseases such as multiple sclerosis, in mobility training, and in physical therapy for sports or other injuries. To further aid such users, the handles (15L, 15R) can comprise special gripping means, such as foam, rubber, texturized metal or plastic, or any other suitable means to strengthen the ability of the users to grip the handles (15L, 15R).

When the handlebar assembly is adjusted to shoulder height, the user can grip the handles (15L, 15R) while standing on one foot to practice a simple balance exercise. By alternating foot positions on the floor, the user can benefit from a variety of walking, dance, or other full range of motion movements while continuously maintaining hand contact, control, and balance, by gripping the handles (15L, 15R). By standing erect and gripping the handles (15L, 15R), the user can perform a squatting exercise movement that simultaneously works the multiple muscle groups of the arms, back, and shoulders as well as the leg muscles.

Arm flexing push-up movements performed with the substantially perpendicular handlebar apparatus 15 allow the user to control and vary the amount of counterforce resistance applied as well as the horizontal plane of application to help stretch and strengthen the multiple muscles that support the spinal column and improve overall posture. Increased gravitational force resistances for this movement is achieved by lowering the height of the handlebar apparatus 15, positioning the feet farther back from the apparatus, and repeating the exercise.

Standing upright with the handlebar apparatus 15 at eye level, the user can perform a forward lunge movement by bending one knee and lowering the head and shoulders below the horizontal axis of the height stabilized handlebar apparatus 15, allowing full participation of the upper body muscles as well as the large bone marrow building muscles of the legs. The user can continue the exercise by returning to a straight upright position, bending the other knee and repeating the movement.

To relieve stress, the user can firmly grasp the handles (15L, 15R), bend the erect body forward at the waist while leaning back to perform a full extension jack knife movement that stretches and strengthens the muscles of the arms, upper and lower back, chest, shoulders, and the abdomen. The user can hold the stretch and breathe deeply. Then, the user can return to a straight upright position and repeat the movement.

In certain embodiments of the present invention, the flange assembly 13 is rotationally coupled to the shaft 11 so that the flange assembly 13 can rotate about the shaft 11. In such embodiments, the user can rotate the handlebar assembly for a variety of oblique movements and exercises that target multiple muscle groups. For example, the user can perform certain oblique movements to imitate a slalom skier.

Figure 3:
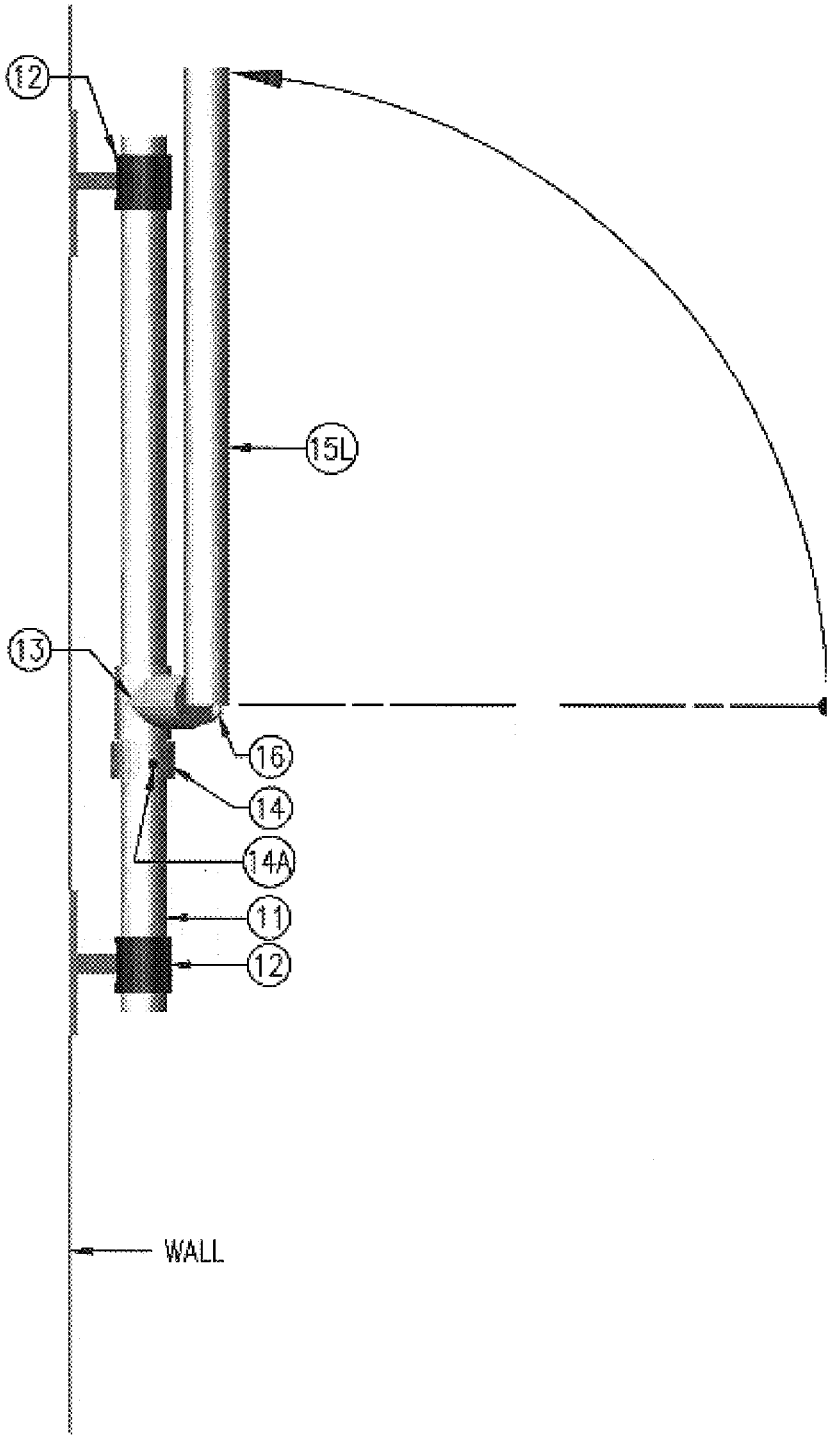
FIG. 3 is an illustration of a left side perspective view of a universal fitness apparatus, according to an exemplary embodiment of the present invention, shown with its handles in a stored position.

FIG. 3 illustrates a left side perspective view of a universal fitness apparatus, according to an exemplary embodiment of the present invention, shown with its handles in a stored position. The receptacles of the flange assembly 13 are pivotally movable relative to an axis substantially perpendicular to the shaft 11 so that, when the device is not in use, the user can raise the handles (15L, 15R) into an upright position. Thus, the user can conveniently and compactly store the apparatus between uses.

Figure 4:
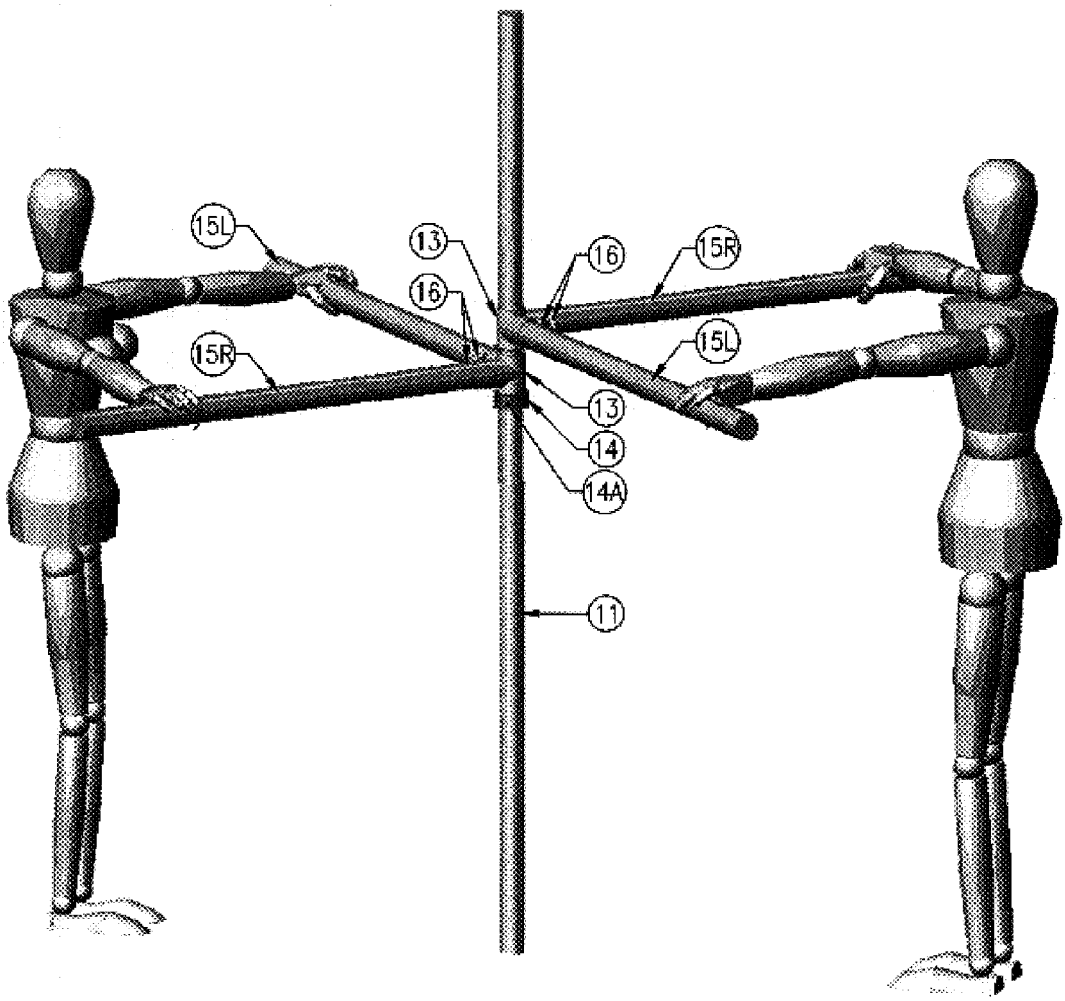
FIG. 4 is an illustration of a perspective side view of a universal fitness apparatus, according to an exemplary embodiment of the present invention, shown employed by two users standing in upright positions.

FIG. 4 illustrates a perspective side view of a universal fitness apparatus, according to an exemplary embodiment of the present invention, shown employed by two users standing in upright positions. Two handlebar assemblies, one for each user depicted in the figure, are coupled to the shaft 11. Accordingly, the users can simultaneously use the apparatus. For example, training, dance, or therapy partners can simultaneously exercise using their own handlebar assemblies. Individual routines can be prescribed or choreographed with almost limitless combinations of enjoyable, healthy, and therapeutic muscle movements.

Though only two handlebar assemblies are illustrated in FIG. 4, it will be readily apparent to a person of ordinary skill in the art that many more handlebar assemblies can be coupled to the shaft 11 for simultaneous use of the apparatus by multiple persons. In an alternative embodiment, rather than have multiple handlebar assemblies comprising flange assemblies 13, receptacles, and handles (15L, 15R), a single flange assembly 13 can comprise the multiple handles (15L, 15R).

Figure 5:
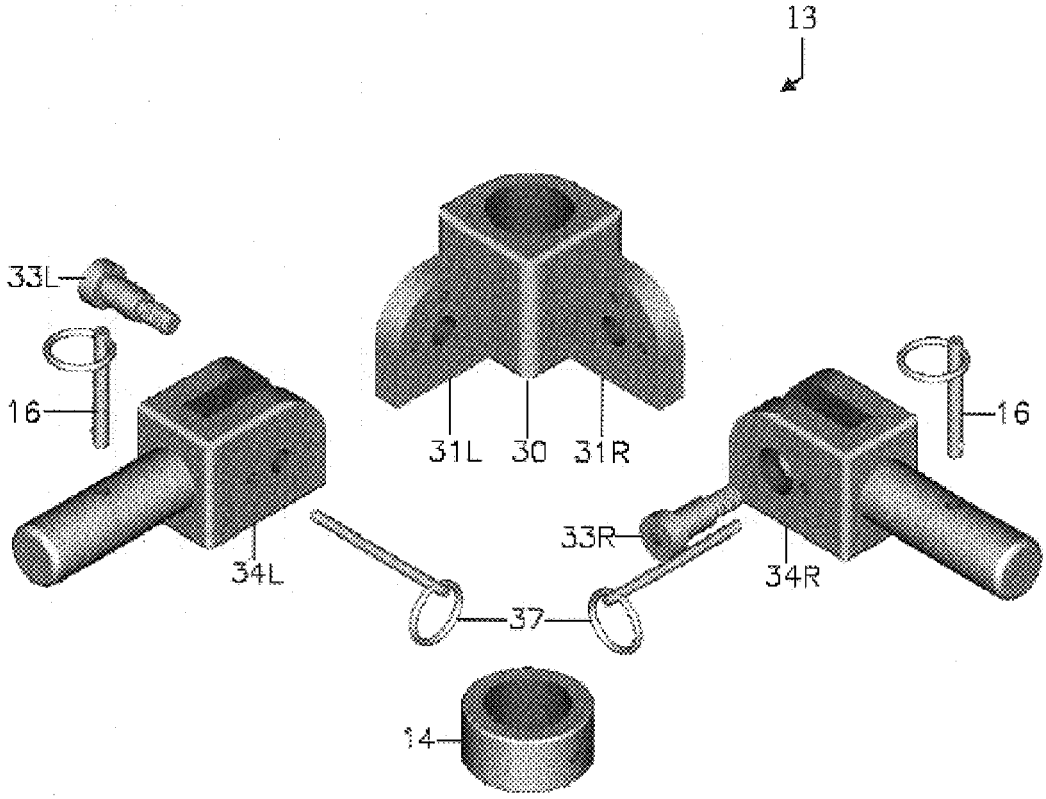
FIG. 5 is an illustration of an exploded view of a flange assembly of a universal fitness apparatus, according to an exemplary embodiment of the present invention.

FIG. 5 is an illustration of an exploded view of a flange assembly 13 of a universal fitness apparatus, according to an exemplary embodiment of the present invention. The flange assembly 13 comprises a side outlet flange 30 having a first outlet 31L and a second outlet 31R. The first outlet 31L is coupled to a first receptacle 34L by means of a shoulder bolt 33L. In a similar manner, the second outlet 31R is coupled to a second receptacle 34R by means of a shoulder bolt 33R. Other methods for securing the receptacles (34L, 34R) to the outlets (31L, 31R) of the side outlet flange 30, including without limitation straps, brackets, braces, hooks, clips, rings, loop fasteners, ties, pins, screws, nails, concrete, adhesive glue or tape, and/or any other suitable attachment means, will occur to those of ordinary skill in the art.

Each of the receptacles (34L, 34R) is configured to receive a handle (not shown). The handles can be secured to the receptacles (34L, 34R) by removable detention pins 16, placed in vertically aligned holes drilled into the handles and the receptacles (34L, 34R). When the apparatus is not in use, the user can remove the handles from the receptacles (34L, 34R) for compact storage. Other suitable methods for securing the handles to the receptacles (34L, 34R) will occur to those of ordinary skill in the art. Such methods can removably or permanently secure the handles to the receptacles (34L, 34R).

In certain embodiments of the present invention, each of the receptacles (34L, 34R) is pivotally movable relative to an axis substantially perpendicular to the shaft (not shown) so that, when the device is not in use, the user can raise the handles into an upright position for compact storage. To secure the handles in such an upright position, removable detention pins 37 can be placed in horizontally aligned holes drilled into the receptacles (34L, 34R) and the first and second outlets (31L, 31R). Similarly, to secure the handles in their ordinary, operating position, the detention pins 37 can be placed in the horizontally aligned holes drilled into the receptacles (34L, 34R) and the first and second outlets (31L, 31R). Other suitable methods for securing the handles in either an upright or operating position will occur to those of ordinary skill in the art.

Figure 6:
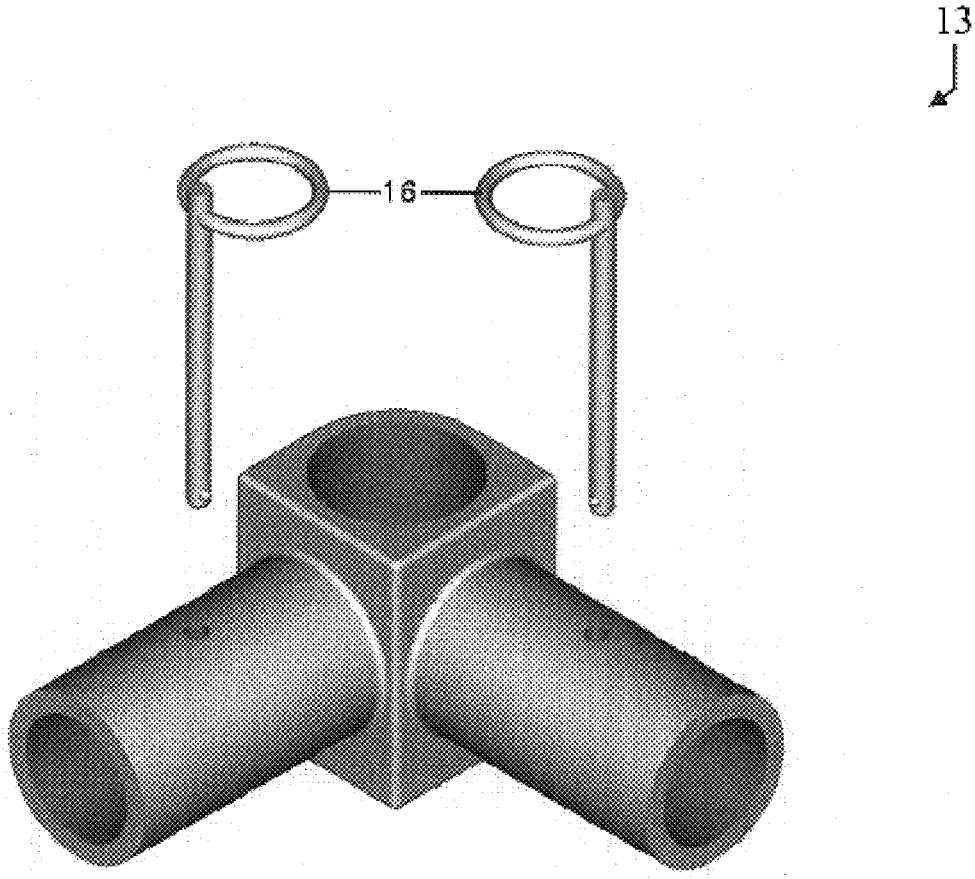
FIG. 6 is an illustration of an exploded view of a flange assembly of a universal fitness apparatus, according to an alternative exemplary embodiment of the present invention.

FIG. 6 is an illustration of an exploded view of a flange assembly 13 of a universal fitness apparatus, according to an alternative exemplary embodiment of the present invention. The flange assembly 13 comprises two receptacles that are each configured to receive a handle (not shown). The handles can be secured to the flange assembly 13 using removable detention pins 16, placed in vertically aligned holes drilled into the handles and the flange assembly 13. When the apparatus is not in use, the user can remove the handles from the receptacles for compact storage. Other suitable methods for securing the handles to the flange assembly 13 will occur to those of ordinary skill in the art. Such methods can removably or permanently secure the handles to the flange assembly 13.

Figure 7:
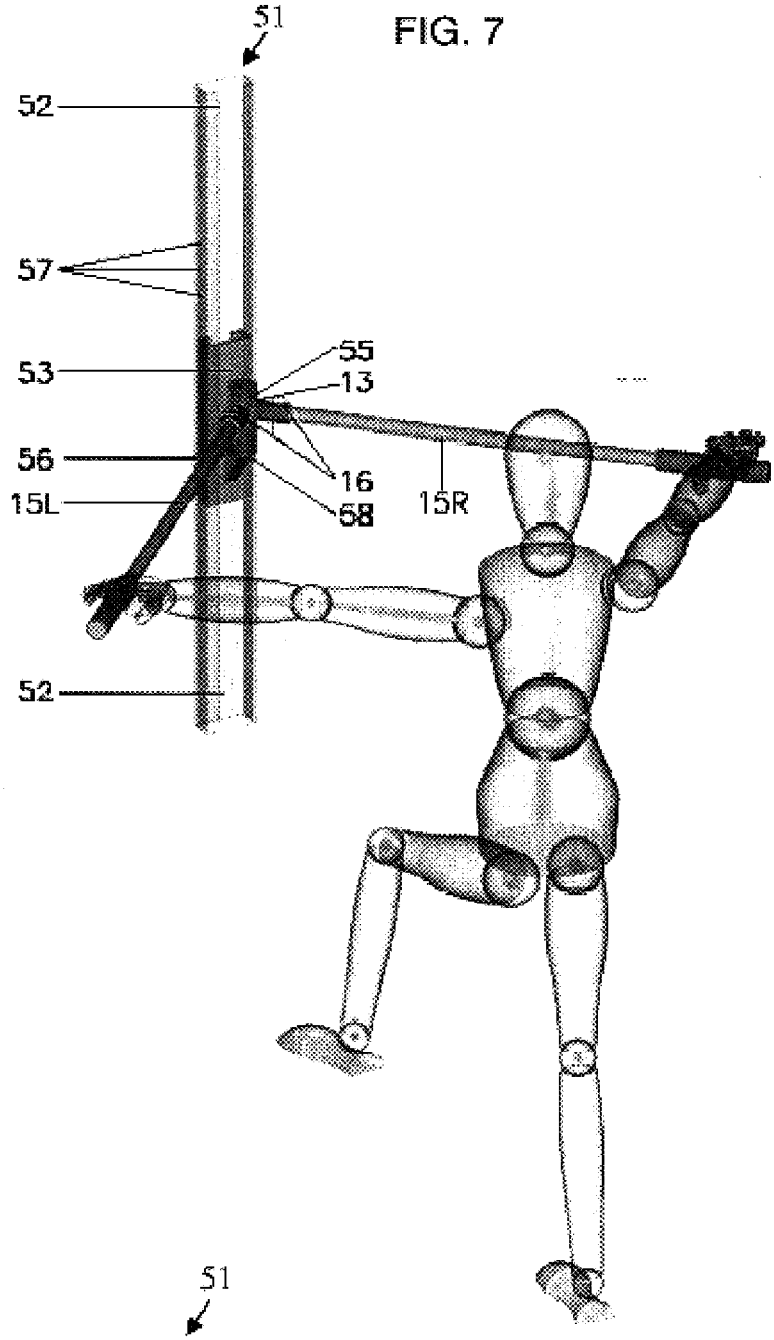
FIG. 7 is an illustration of a left side perspective view of a universal fitness apparatus, according to an alternative exemplary embodiment of the present invention, shown employed by a user performing a leg lift exercise.

FIG. 7 is an illustration of a left side perspective view of a universal fitness apparatus, according to an alternative exemplary embodiment of the present invention, shown employed by a user performing a leg lift exercise. The universal fitness apparatus comprises a longitudinal track 51, secured at each end to a supporting structure (not shown) by means of standard metal screws 52. The screws 52 and supporting structure help to maintain the longitudinal track 51 in a substantially vertical position. In certain embodiments of the present invention, alternative means can be utilized for that purpose. For example, the apparatus can be secured to a supporting structure using straps, brackets, braces, hooks, clips, rings, loop fasteners, ties, pins, nails, concrete, adhesive glue or tape, welding, and/or any other suitable mounting or attachment means. The mounting or attachment means can be disposed on or near any number of sites on the apparatus and/or the supporting structure. In addition, any number of supporting structures can be utilized. For example, a supporting structure can be a floor, a wall, a door, a beam, a ceiling, the ground, and/or any other suitable supporting means.

The longitudinal track 51 can comprise metal, such as aluminum or steel, plastic, wood, and/or any other suitable material known in the art. Though the longitudinal track 51 illustrated in FIG. 7 has a rectangular shape, in alternative embodiments of the present invention, the longitudinal track 51 can have any of a number of other suitable shapes, including without limitation a cylindrical shape. The longitudinal track 51 ordinarily will have a length between approximately 3 and 7 feet, a width of 2 inches, and a depth of 2 inches. It will be readily apparent to one of ordinary skill in the art that the length, width, and depth of the longitudinal track 51 can vary depending upon the intended use of the apparatus. For example, an apparatus intended to be mounted to an interior wall of a house for use by a family can have a smaller longitudinal track 51 length, width, and/or depth than that of an apparatus intended to be placed in an outdoor recreation facility for use by the public.

Coupled to the longitudinal track 51 is a runner 53 that is configured to slide along the interior axis of the longitudinal track 51. In an alternative embodiment of the present invention, the runner 53 can be configured to slide along the exterior axis of the longitudinal track 51. A user of the apparatus can raise or lower the runner 53 to a desired height and then lock the runner 53 in place by placing a removable detention pin 56 in horizontally aligned holes 57 drilled into the longitudinal track 51 and the runner 53. Typically, the holes 57 in the longitudinal track 51 and the runner 53 are equally spaced 2 to 3 inches apart. Suitable alternative spacing configurations, including unequally spaced holes, and suitable alternative means for locking the runner 53 in place will be readily apparent to persons of ordinary skill in the art.

The runner 53 can comprise metal, such as aluminum or steel, plastic, wood, and/or any other suitable material known in the art. Though the runner 53 illustrated in FIG. 7 has a rectangular shape, in alternative embodiments of the present invention, the runner 53 can have any of a number of other suitable shapes, including without limitation a cylindrical shape. The runner 53 ordinarily will have a length of approximately 10 inches, a width of 1⅝ inches, and a depth of 1 inch. It will be readily apparent to one of ordinary skill in the art that the length, width, and depth of the runner 53 can vary depending upon the intended use of the apparatus.

Mounted to the runner 53 is a flange assembly 13 comprising two receptacles for receiving handles (15L, 15R). Each handle (15L, 15R) can be secured to the flange assembly 13 using removable detention pins 16, placed in vertically aligned holes drilled into the handle (15L, 15R) and the flange assembly 13. When the apparatus is not in use, the user can remove the handles (15L, 15R) from the receptacles for compact storage. Other methods for securing the handles (15L, 15R) to the flange assembly 13, including without limitation straps, brackets, braces, hooks, clips, rings, loop fasteners, ties, pins, screws, nails, concrete, adhesive glue or tape, and/or any other suitable attachment means will occur to those of ordinary skill in the art. Such methods can removably or permanently secure the handles (15L, 15R) to the flange assembly 13.

Though illustrated in the Figures as tubular members, the handles (15L, 15R) can be of any suitable shape, and comprise any suitable material, such as aluminum or steel, plastic, wood, and/or any other suitable material known in the art, for supporting a user. Ordinarily, the handles (15L, 15R) will have a length of approximately 24 inches and a diameter between approximately 1¼ and 1⅜ inches. It will be readily apparent to one of ordinary skill in the art that the length and diameter of each handle (15L, 15R) can vary depending upon the intended use of the apparatus. In alternative embodiments of the present invention, rather than comprise receptacles for receiving handles (15L, 15R), the flange assembly 13 itself can comprise the handles (15L, 15R). The combination of the flange assembly 13 and the secured handles (15L, 15R) is referred to herein as a "handlebar assembly."

The flange assembly 13 is mounted to the runner 53 by means of a longitudinal shaft 55 and a shaft support 58. The shaft support 58 is coupled to, or a component of, the runner 53. Coupled to, or as a component of the shaft support 58, is the longitudinal shaft 55. The shaft support 58 helps to maintain the longitudinal shaft 55 in a substantially vertical position and to support at least a portion of the weight of the handlebar assembly. Though illustrated as a substantially triangular member, the shaft support 58 can be of any of a number of suitable shapes, including without limitation rectangular, circular, and/or semi-circular.

The longitudinal shaft 55 ordinarily will have a length of approximately 4 inches and a diameter of approximately 1 inch, and will be disposed substantially parallel to the longitudinal track 51. It will be readily apparent to one of ordinary skill in the art that the length, diameter, and disposition of the longitudinal shaft 55 can vary depending upon the intended use of the apparatus. In addition, other suitable means for mounting the flange assembly 13 to the runner 35 will be readily apparent to one of ordinary skill in the art.

The flange assembly 13 is configured to slide along the axis of the longitudinal shaft 55. When the apparatus is in use, the flange assembly 13 surrounds the longitudinal shaft 55 and rests on the shaft support 58. When the apparatus is not in use, the user can remove the flange assembly 13 from the longitudinal shaft 55 for compact storage by sliding the flange assembly 13 upward along the longitudinal shaft 55 until the flange assembly 13 no longer surrounds the longitudinal shaft 55. In alternative embodiments of the present invention, the flange assembly 13 can be permanently mounted to the longitudinal shaft 55 and/or runner 53.

The receptacles of the flange assembly 13 are disposed substantially perpendicular to one another and to the longitudinal shaft 55. As a result, when the handles (15L, 15R) are secured to the receptacles, the apparatus simulates an upright wall corner. The user can adjust the height of the flange assembly 13 to his shoulder height and secure the height of the flange assembly 13, thus securing the height of the handlebar assembly 15, using the removable detention pin 56. Then the user can stand upright, facing the longitudinal track 51, place his hands on the handles (15L, 15R), and exert counterforce against the handles (15L, 15R) to develop and condition his back, shoulders, and chest muscles. Through such operation, the user simultaneously performs force resistance, postural, and balance exercises. In alternative embodiments of the present invention, the flange assembly 13 receptacles can be disposed at other angles suitable for such exercises. For example, the receptacles can be disposed at a more shallow, 45° angle, or at a wider, 180° angle. In further alternative embodiments, the receptacles can be pivotally coupled relative to one another and/or to the longitudinal shaft 55 so that the user can customize the angle between the receptacles and/or the angle between the receptacles and the longitudinal shaft 55.

As illustrated in FIG. 7, the user can grip the handles (15L, 15R) for support while performing a variety of exercises. In certain embodiments of the present invention, the flange assembly 13 is rotationally coupled to the longitudinal shaft 55 so that the flange assembly 13 can rotate about the longitudinal shaft 55. In such embodiments, the user can rotate the handlebar assembly 15 for a variety of oblique movements and exercises that target multiple muscle groups. For example, the user can perform certain oblique movements to imitate a slalom skier.

Figure 8:
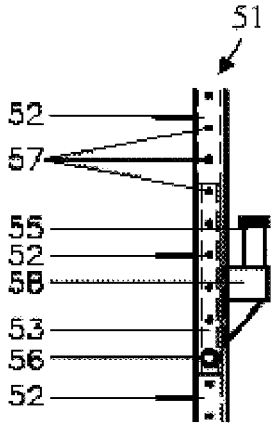
FIG. 8 is an illustration of a left side view of a universal fitness apparatus, according to an alternative exemplary embodiment of the present invention.

FIG. 8 is an illustration of a left side view of a universal fitness apparatus, according to an alternative exemplary embodiment of the present invention. The universal fitness apparatus comprises a longitudinal track 51, secured to a supporting structure (not shown) by means of standard metal screws 52. The screws 52 and supporting structure help to maintain the longitudinal track 51 in a substantially vertical position. In certain embodiments of the present invention, alternative means can be utilized for that purpose. For example, the apparatus can be secured to a supporting structure using straps, brackets, braces, hooks, clips, rings, loop fasteners, ties, pins, nails, concrete, adhesive glue or tape, welding, and/or any other suitable mounting or attachment means. The mounting or attachment means can be disposed on or near any number of sites on the apparatus and/or the supporting structure. In addition, any number of supporting structures can be utilized. For example, a supporting structure can be a floor, a wall, a door, a beam, a ceiling, the ground, and/or any other suitable supporting means.

The longitudinal track 51 can comprise metal, such as aluminum or steel, plastic, wood, and/or any other suitable material known in the art. Though the longitudinal track 51 illustrated in FIG. 8 has a rectangular shape, in alternative embodiments of the present invention, the longitudinal track 51 can have any of a number of other suitable shapes, including without limitation a cylindrical shape. The longitudinal track 51 ordinarily will have a length between approximately 3 and 7 feet, a width of 2 inches, and a depth of 2 inches. It will be readily apparent to one of ordinary skill in the art that the length, width, and depth of the longitudinal track 51 can vary depending upon the intended use of the apparatus. For example, an apparatus intended to be mounted to an interior wall of a house for use by a family can have a smaller longitudinal track 51 length, width, and/or depth than that of an apparatus intended to be placed in an outdoor recreation facility for use by the public.

Coupled to the longitudinal track 51 is a runner 53 that is configured to slide along the interior axis of the longitudinal track 51. In an alternative embodiment of the present invention, the runner 53 can be configured to slide along the exterior axis of the longitudinal track 51. A user of the apparatus can raise or lower the runner 53 to a desired height and then lock the runner 53 in place by placing a removable detention pin 56 in horizontally aligned holes 57 drilled into the longitudinal track 51 and the runner 53. Typically, the holes 57 in the longitudinal track 51 and the runner 53 are equally spaced 2 to 3 inches apart. Suitable alternative spacing configurations, including unequally spaced holes, and suitable alternative means for locking the runner 53 in place will be readily apparent to persons of ordinary skill in the art.

The runner 53 can comprise metal, such as aluminum or steel, plastic, wood, and/or any other suitable material known in the art. Though the runner 53 illustrated in FIG. 8 has a rectangular shape, in alternative embodiments of the present invention, the runner 53 can have any of a number of other suitable shapes, including without limitation a cylindrical shape. The runner 53 ordinarily will have a length of approximately 10 inches, a width of 1⅝ inches, and a depth of 1 inch. It will be readily apparent to one of ordinary skill in the art that the length, width, and depth of the runner 53 can vary depending upon the intended use of the apparatus.

Coupled to, or a component of the runner 53, is a shaft support 58. Coupled to, or a component of the shaft support 58, is a longitudinal shaft 55. The shaft support 58 helps to maintain the longitudinal shaft 55 in a substantially vertical position. Though illustrated as a substantially triangular member, the shaft support 58 can be of any of a number of suitable shapes, including without limitation rectangular, circular, and/or semi-circular.

The longitudinal shaft 55 ordinarily will have a length of approximately 4 inches and a diameter of approximately 1 inch, and will be disposed substantially parallel to the longitudinal track 51. It will be readily apparent to one of ordinary skill in the art that the length, diameter, and disposition of the longitudinal shaft 55 can vary depending upon the intended use of the apparatus.

A flange assembly (not shown) can be configured to slide along the axis of the longitudinal shaft 55. When the apparatus is in use, the flange assembly can surround the longitudinal shaft 55 and rest on the shaft support 58. When the apparatus is not in use, the user can remove the flange assembly from the longitudinal shaft 55 for compact storage by sliding the flange assembly upward along the longitudinal shaft 55 until the flange assembly no longer surrounds the longitudinal shaft 55. In alternative embodiments of the present invention, the flange assembly can be permanently mounted to the longitudinal shaft 55 and/or runner 53.

In conclusion, the foregoing exemplary embodiments enable a universal fitness apparatus for force resistance, postural, and balance exercises. Many other modifications, features, and embodiments of the present invention will become evident to those of ordinary skill in the art. It should be appreciated, therefore, that many aspects of the present invention were described above by way of example only and are not intended as required or essential elements of the invention unless explicitly stated otherwise. Accordingly, it should be understood that the foregoing relates only to certain embodiments of the invention and that numerous changes can be made therein without departing from the spirit and scope of the invention as defined by the following claims. It should also be understood that the invention is not restricted to the illustrated embodiments and that various modifications can be made within the scope of the following claims.

I claim:

1. A universal fitness apparatus, comprising:

a shaft;

an assembly disposed about the shaft and rotatable around the shaft during a fitness operation, the assembly comprising a first receptacle and a second receptacle, each of the first receptacle and the second receptacle being pivotally movable relative to a plane perpendicular to the shaft and disposed substantially perpendicular to the shaft during the fitness operation;

a first handle coupled to the first receptacle; and a second handle coupled to the second receptacle.

2. The universal fitness apparatus of claim 1, wherein the first receptacle is disposed substantially perpendicular to the second receptacle.

3. The universal fitness apparatus of claim 1, wherein the assembly is configured to slide along an axis of the shaft.

4. The universal fitness apparatus of claim 3, further comprising a collar disposed about the shaft, the collar configured to hold the assembly in place at a particular position along the axis of the shaft.

5. The universal fitness apparatus of claim 1, further comprising:

one or more support configured for mounting the shaft to a support surface.

6. The universal fitness apparatus of claim 5, wherein the support surface is a wall.

7. The universal fitness apparatus of claim 1, wherein each of the first handle and the second handle comprises a tubular member.

8. The universal fitness apparatus of claim 1, wherein the first handle is removably coupled to the first receptacle and the second handle is removably coupled to the second receptacle.

9. The universal fitness apparatus of claim 1, wherein the assembly is removably coupled to the shaft.

10. A universal fitness apparatus, comprising:

a track;

a runner coupled to the track and configured to slide along an axis of the track;

a shaft coupled to the runner and disposed substantially parallel to the runner;

an assembly disposed about the shaft and rotatable around the shaft during a fitness operation, the assembly comprising a first receptacle and a second receptacle;

a first handle coupled to the first receptacle; and a second handle coupled to the second receptacle.

11. The universal fitness apparatus of claim 10, wherein each of the runner and the track comprises horizontally aligned holes configured to receive a connecting pin.

12. The universal fitness apparatus of claim 10, wherein the runner is configured to slide along an interior axis of the track.

13. The universal fitness apparatus of claim 10, wherein the runner is configured to slide along an exterior axis of the track.

14. The universal fitness apparatus of claim 10, wherein the assembly is removably mounted to the shaft.

15. The universal fitness apparatus of claim 10, wherein the first receptacle is disposed substantially perpendicular to the second receptacle.

16. The universal fitness apparatus of claim 10, further comprising:

one or more support configured for mounting the track to a support surface.

17. The universal fitness apparatus of claim 16, wherein the support surface is a wall.

18. The universal fitness apparatus of claim 10 wherein each of the first handle and the second handle comprises a tubular member.

19. A universal fitness apparatus, comprising:

a shaft;

an assembly disposed about the shaft and rotatable around the shaft during a fitness operation, the assembly comprising a first receptacle and a second receptacle, each of the first receptacle and the second receptacle being pivotally movable relative to a plane perpendicular to the shaft and disposed substantially perpendicular to the shaft during the fitness operation;

a first handle coupled to the first receptacle;

a second handle coupled to the second receptacle; and wherein the first handle and the second handle are configured to enable a user to apply personal counterforce resistance during the fitness operation.

20. The universal fitness apparatus of claim 19, wherein the assembly is removably coupled to the shaft.

21. The universal fitness apparatus of claim 19, wherein the assembly is configured to slide along an axis of the shaft.

22. The universal fitness apparatus of claim 21, further comprising a collar disposed about the shaft, the collar configured to hold the assembly in place at a particular position along the axis of the shaft.

* * * * *